US007694954B2

(12) United States Patent
Lee

(10) Patent No.: US 7,694,954 B2
(45) Date of Patent: Apr. 13, 2010

(54) SHEET PICK-UP DEVICE

(75) Inventor: Hsin-Wen Lee, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 441 days.

(21) Appl. No.: 11/470,718

(22) Filed: Sep. 7, 2006

(65) Prior Publication Data

US 2008/0023904 A1 Jan. 31, 2008

(30) Foreign Application Priority Data

Jul. 26, 2006 (TW) ..... 95127230 A

(51) Int. Cl.
*B65H 3/06* (2006.01)

(52) U.S. Cl. ..... 271/117; 271/113; 271/118; 271/10.09; 271/18; 271/109; 271/114

(58) Field of Classification Search ..... 271/113, 271/117, 118, 10.09, 18, 109, 114
See application file for complete search history.

(56) References Cited

U.S. PATENT DOCUMENTS 5,040,779 A * 8/1991 Ogiri et al. ..... 271/109
6,764,072 B2 * 7/2004 Gaarder ..... 271/121
6,896,254 B2 * 5/2005 Koh et al. ..... 271/117
7,152,858 B2 * 12/2006 Lin ..... 271/117
7,252,283 B2 * 8/2007 Lan et al. ..... 271/34
2005/0127592 A1 * 6/2005 Chang ..... 271/109
2005/0194732 A1 * 9/2005 Asada ..... 271/113
2006/0180985 A1 * 8/2006 Lee et al. ..... 271/109

* cited by examiner

*Primary Examiner*—Patrick H Mackey
*Assistant Examiner*—Prasad V Gokhale
(74) *Attorney, Agent, or Firm*—Kirton & McConkie; Evan R. Witt

(57) ABSTRACT

A sheet pick-up device includes a sheet pick-up arm, a driving shaft and a collar. The sheet pick-up arm has a sleeve at the outside surface thereof. The driving shaft is penetrated through the sheet pick-up arm and the sleeve. The collar is sheathed around the driving shaft and includes at least one flexible vane in contact with the inner surface of the sleeve. The height of the flexible vane relative to the outer surface of the collar is greater than the radial distance between the outer surface of the collar and the inner surface of the sleeve.

6 Claims, 5 Drawing Sheets

SHEET PICK-UP DEVICE

FIELD OF THE INVENTION

The present invention relates to a sheet pick-up device, and more particularly to a sheet pick-up device used in a document feeder for feeding the paper sheets one by one.

BACKGROUND OF THE INVENTION

Image capturing apparatuses such as image scanners, facsimile machines, printers or copiers are widely used for capturing or scanning images of documents. As known, the image capturing apparatus usually has a document feeder for successively and continuously feeding many paper sheets. Typically, the document feeder has a sheet pick-up device in contact with the front edges of the documents so as to feed the paper sheets one by one.

Referring to FIGS. 1A and 1B, schematic cross-sectional views of a sheet pick-up device of a document feeder are respectively illustrated. FIG. 1A schematically illustrates the sheet pick-up device in a feeding mode. FIG. 1B schematically illustrates the sheet pick-up device in a standby mode. The sheet pick-up device 2 is disposed under an upper cover 3. The operation principles of the sheet pick-up device in the feeding mode and the standby mode are illustrated as follows.

As shown in FIG. 1A, when the document feeder 1 is operated in the feeding mode, a driving shaft 21 of the sheet pick-up device 2 is driven by a motor (not shown) to rotate in a direction R1, and a sheet pick-up arm 22 of the sheet pick-up device 2 is lowered to a sheet feeding position. Meanwhile, a sheet pick-up roller 221 of the sheet pick-up arm 22 transports a document S forwardly and a sheet separation roller 222 of the sheet pick-up arm 22 is rotated to separate the top paper sheet from the stack of paper sheets, thereby picking a single paper sheet.

As shown in FIG. 1B, after the document S has been fed across the sheet separation roller 222, the driving shaft 21 is driven by the motor to rotate in a direction R2, the sheet pick-up arm 22 of the sheet pick-up device 2 is lifted to a standby position.

In the above document feeder 1, the sheet pick-up arm 22 is transmitted by the driving shaft 21 to move in either the sheet feeding position or the standby position with the assistance of two one-way spring clutches. Referring to FIG. 1C, a schematic perspective view of the sheet pick-up device 2 is illustrated. The sheet pick-up device 2 of FIG. 1C includes two one-way spring clutches 23A and 23B, which are mounted on the driving shaft 21 and connected to the sheet pick-up arm 22. The operation principles of these two one-way spring clutches 23A and 23B will be illustrated as follows.

First of all, please refer to FIGS. 1A, 1B and 1C. When a sheet feeding operation of the document feeder 1 is initiated, the driving shaft 21 is rotated in the direction R1 by the spring clutch 23A so as to descend the sheet pick-up arm 22 to the sheet feeding position. When the sheet feeding operation is terminated, the driving shaft 21 is rotated in the direction R2 and the loading generated from the sheet pick-up arm 22 is balanced off by the spring clutch 23A. Meanwhile, the sheet pick-up arm 22 is lifted to the standby position.

Please refer to FIGS. 1A, 1B and 1C again. When the sheet pick-up arm 22 is further lifted to touch the upper cover 3, the spring clutch 23B is operated to allow for idle running of the driving shaft 21 in the direction R2, thereby reducing the possibility of uplifting the upper cover 3 by the sheet pick-up arm 22.

A sheet pick-up device which has two one-way spring clutches was disclosed in for example U.S. Pat. No. 6,390,463, the contents of which are hereby incorporated by reference.

Although the approach of mounting two one-way spring clutches 23A and 23B on the driving shaft is advantageous for reducing the possibility of uplifting the upper cover by the sheet pick-up arm, there are still some drawbacks. For example, the extra one-way spring clutch increases the cost of the document feeder 1 as well as the complexity of the sheet pick-up device 2.

In views of the above-described disadvantages resulted from the prior art, the applicant keeps on carving unflaggingly to develop an improved sheet pick-up device according to the present invention through wholehearted experience and research.

SUMMARY OF THE INVENTION

It is an object of the present invention to provide a sheet pick-up device used in a document feeder, in which the spring clutch is replaced by a collar having a flexible vane so as to reduce the complexity of the sheet pick-up device and the cost of the document feeder.

In accordance with an aspect of the present invention, there is provided a sheet pick-up device. The sheet pick-up device includes a sheet pick-up arm, a driving shaft and a collar. The sheet pick-up arm has a sleeve at the outside surface thereof. The driving shaft is penetrated through the sheet pick-up arm and the sleeve. The collar is sheathed around the driving shaft and includes at least one flexible vane in contact with the inner surface of the sleeve. The height of the flexible vane relative to the outer surface of the collar is greater than the radial distance between the outer surface of the collar and the inner surface of the sleeve.

In an embodiment, the sheet pick-up arm further comprises a frame and a sheet separation roller. The frame is coupled to the sleeve. The sheet separation roller is disposed inside the frame and sheathed around the driving shaft.

Preferably, the flexible vane is a rubbery strip.

Preferably, the flexible vane is a metallic strip.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
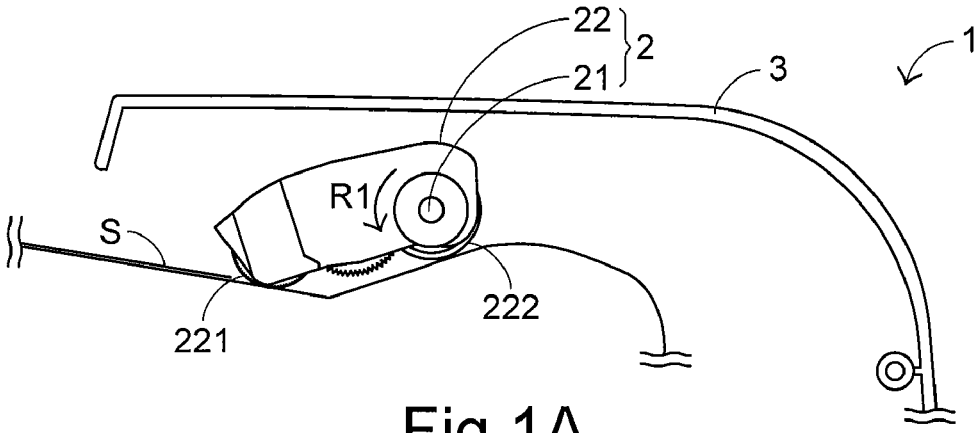
Fig.1A PRIOR ART
FIG. 1A schematically illustrates a conventional document feeder in a sheet feeding position.
Figure 1B:
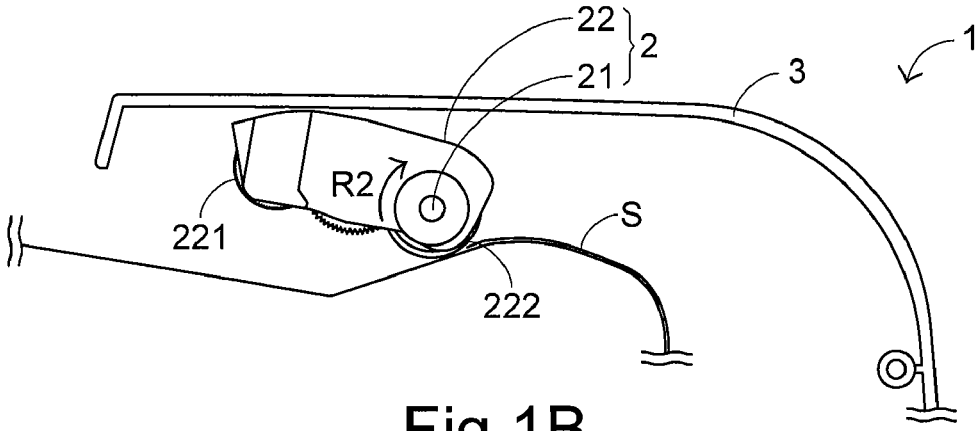
Fig.1B PRIOR ART
FIG. 1B schematically illustrates the conventional document feeder in a standby position.
Figure 1C:
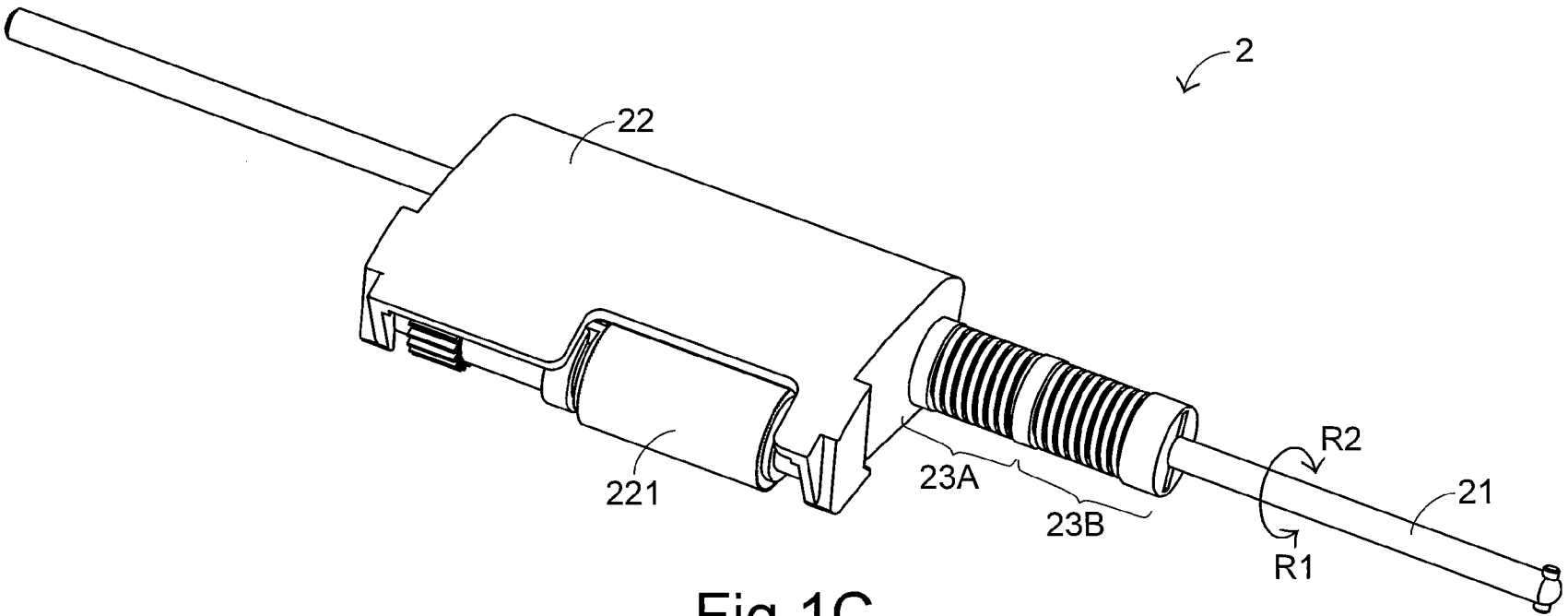
Fig.1C PRIOR ART
FIG. 1C is a schematic perspective view of the sheet pick-up device used in the conventional document feeder.
Figure 2A:
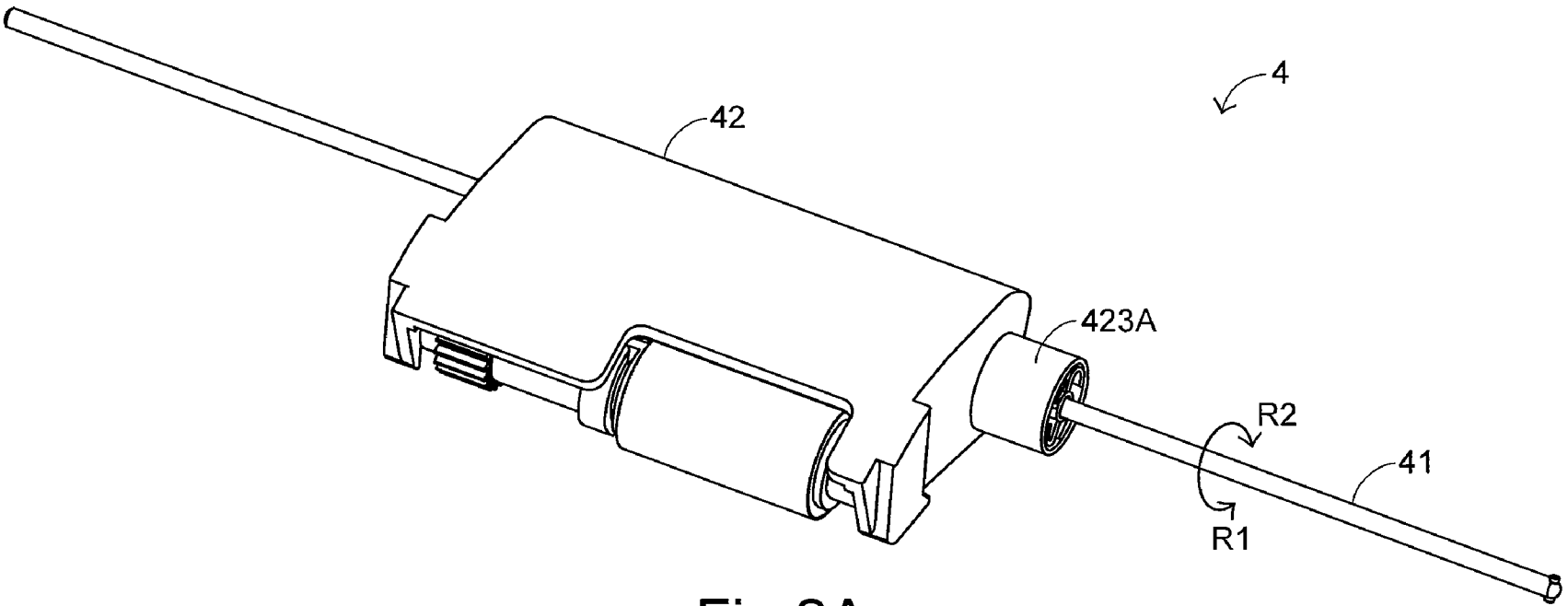
FIG. 2A is a schematic perspective view of a sheet pick-up device according to a preferred embodiment of the present invention.
Figure 2B:
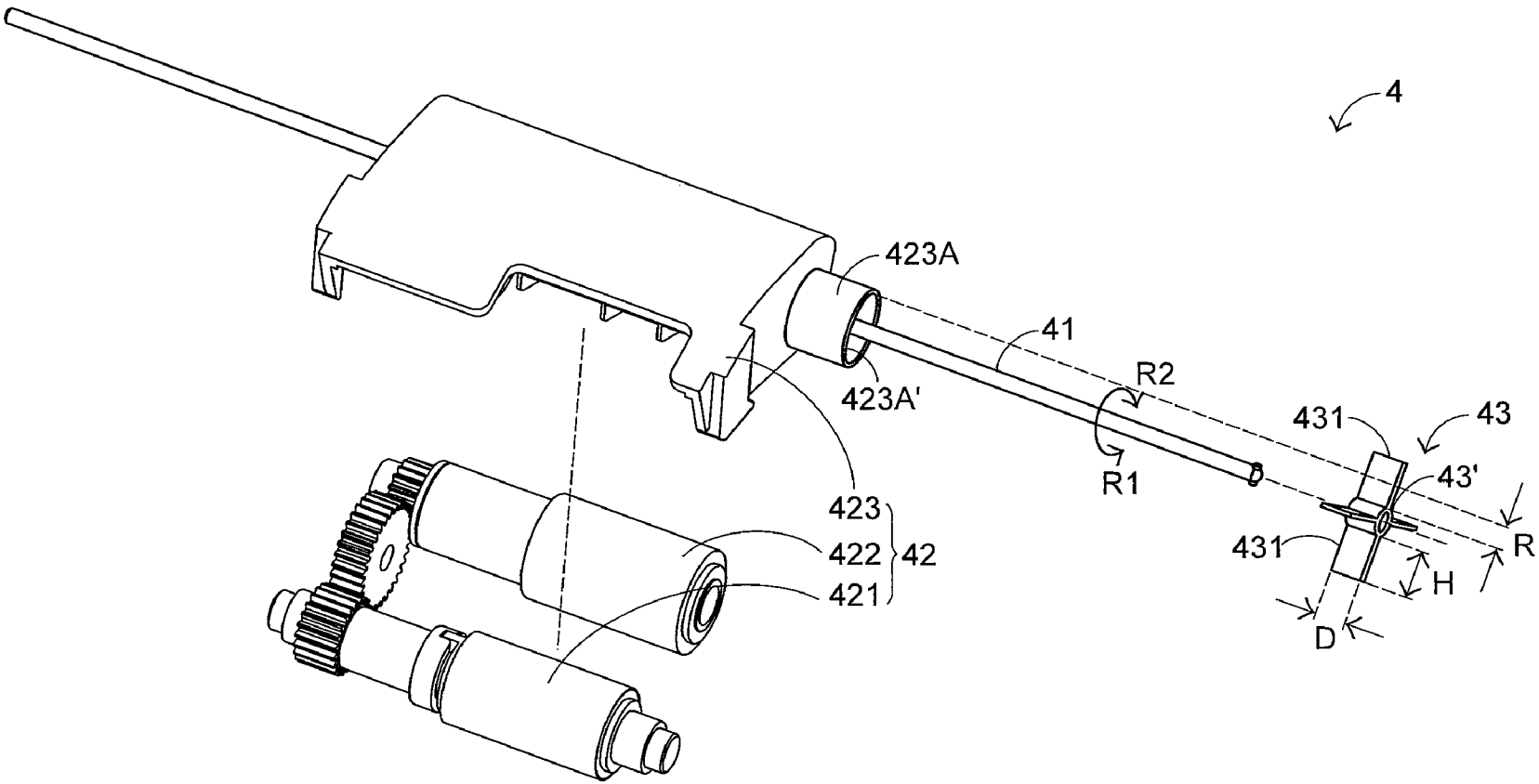
FIG. 2B is a schematic exploded view of the sheet pick-up device of FIG. 2A.

Referring to FIGS. 2A and 2B, schematic perspective and exploded views of a sheet pick-up device according to a preferred embodiment of the present invention are respectively illustrated.

As shown in FIGS. 2A and 2B, the sheet pick-up device 4 comprises a driving shaft 41, a sheet pick-up arm 42 and a collar 43. The sheet pick-up arm 42 is pivotally coupled to the driving shaft 41, and includes a sheet pick-up roller 421, a sheet separation roller 422 and a frame 423. The sheet pick-up roller 421 and the sheet separation roller 422 are disposed inside the frame 423. The frame 423 further includes a sleeve 423A arranged on the outer surface thereof for accommodating the collar 43 therein. The driving shaft 41 is penetrated through the sheet separation roller 422 and the sleeve 423A of the frame 423, so that the driving shaft 41 is combined with the sheet pick-up arm 42. As a result, the driving shaft 41 is driven by a motor (not shown) to either descend the sheet pick-up arm 42 to the sheet feeding position or raise the sheet pick-up arm 42 to the standby position.

Please refer to FIGS. 2A and 2B again. The collar 43 is sheathed around the driving shaft 41. In addition, a plurality of flexible vanes 431 extended from the outer surface 43' of the collar 43. In accordance with a specific feature of the present invention, the height H of each flexible vane 431 relative to the outer surface 43' of the collar 43 is greater than the radial distance R between the outer surface 43' of the collar 43 and the inner surface 423A' of the sleeve 423A. After the collar 43 is sheathed around the driving shaft 41 and rotated in the direction R1 to be embedded within the sleeve 423A, each flexible vane 431 is deformed to have a curved shape because a portion of the flexible vane 431 is in contact with the inner surface 423A' of the sleeve 423A.

Figure 3A:
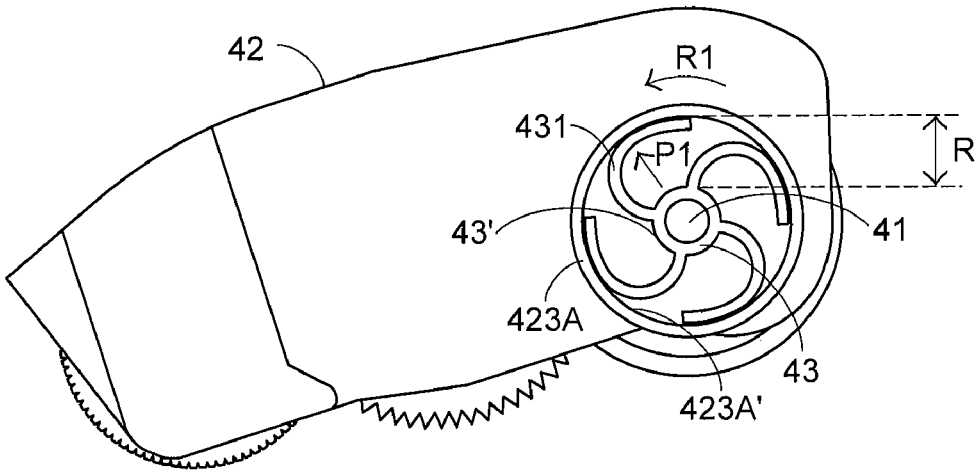
FIG. 3A is a schematic side view illustrating the operation of adjusting the sheet pick-up arm to the sheet feeding position.
Figure 3B:
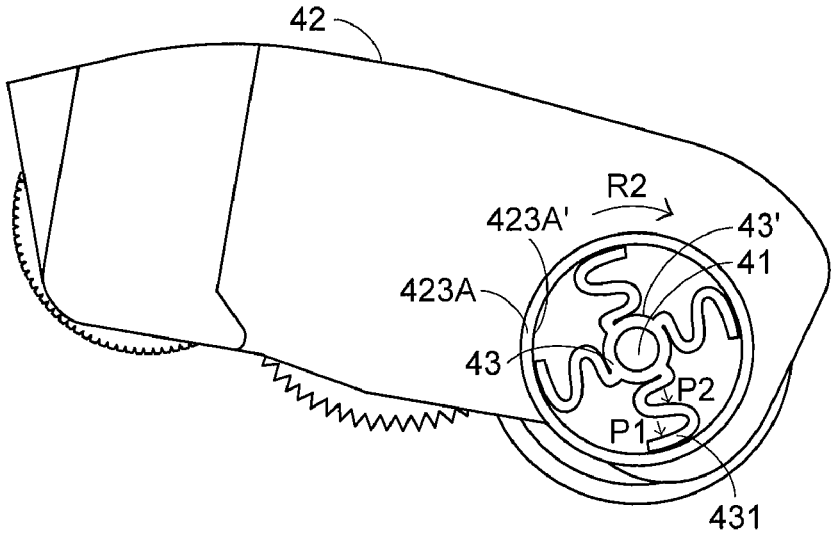
FIG. 3B is a schematic side view illustrating the operation of adjusting the sheet pick-up arm to the standby position.

Hereinafter, the operations of adjusting the sheet pick-up arm 42 to the sheet feeding position and the standby position by the driving shaft 41 and the collar 43 will be illustrated in more details with reference to the side views of the sheet pick-up device 4 as shown in FIGS. 3A and 3B.

As shown in FIG. 3A, when the driving shaft 41 is rotated in the direction R1, the force P1 resulted from the deformed flexible vanes 431 and exerted on the inner surface 423A' of the sleeve 423A is less than the weight loading of sheet pick-up arm 42 on the driving shaft 41. As a consequence, the sheet pick-up arm 42 is lowered to the sheet feeding position. Next, as shown in FIG. 3B, when the sheet feeding operation is terminated, the driving shaft 41 is rotated in the direction R2 and the flexible vane 431 is deformed to have a wavy shape. The term "wavy shape" used herein means that the flexible vane 431 has plural bending portions. At that moment, the forces P1 and P2 resulted from the deformed flexible vanes 431 and exerted on the inner surface 423A' of the sleeve 423A are greater than the weight loading of sheet pick-up arm 42 on the driving shaft 41, so that the sheet pick-up arm 42 is lifted to the standby position.

Please refer to FIG. 3B again. When the driving shaft 41 is continuously rotated in the direction R2 and the sheet pick-up arm 42 is further raised to touch the upper cover (not shown), the more deformed flexible vane 431 is effective for balancing rotation of the driving shaft 41. Under this circumstance, the possibility of uplifting the upper cover by the sheet pick-up arm 42 is minimized.

In the above embodiments of the sheet pick-up device 4, the flexible vanes 431 of the collar 43 are preferably made of rubbery material or metallic material, for example a rubbery strip or a metallic strip. Depending on the weight and size of the sheet pick-up arm 42, the height H of each flexible vane 431 relative to the outer surface 43' of the collar 43, the width D of each flexible vane 431 and the number of the flexible vanes 431 are varied. For example, if the sheet pick-up arm 42 is relatively weightier, the height H of each flexible vane 431 relative to the outer surface 43' of the collar 43, the width D of each flexible vane 431 or the number of the flexible vanes 431 can be increased. Under this circumstance, the frictional force generated between the flexible vanes 431 and the inner surface 423A' of the sleeve 423A are increased, so that the sheet pick-up arm 42 is lifted to the standby position.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet pick-up device comprising:

a sheet pick-up arm having a sleeve at the outside surface thereof, wherein said sheet pick-up arm further comprises:

a frame coupled to said sleeve; and a sheet separation roller disposed inside said frame and sheathed around a driving shaft;

said driving shaft penetrated through said sheet pick-up arm and said sleeve; and a collar sheathed around said driving shaft and including at least one flexible vane in contact with the inner surface of said sleeve, wherein the height of said flexible vane relative to the outer surface of said collar is greater than the radial distance between the outer surface of said collar and the inner surface of said sleeve, wherein the height of said flexible vane is completely disposed between said collar and the inner surface of said sleeve, and wherein said collar and said flexible vane rotate within an inner space defined by said inner surface upon rotation of said driving shaft.

2. The sheet pick-up device according to claim 1 wherein said flexible vane is a rubbery strip.

3. The sheet pick-up device according to claim 1 wherein said flexible vane is a metallic strip.

4. The sheet pick-up device according to claim 1, wherein said flexible vane comprises a bending portion disposed between said collar and the inner surface of said sleeve.

5. The sheet pick-up device according to claim 1, wherein said flexible vane is configured to flex and comprise a plurality of bending portions disposed between said collar and the inner surface of said sleeve.

6. The sheet pick-up device according to claim 1, wherein a portion of said flexible vane contacts and conforms to a rounded portion of the inner surface of said sleeve.

* * * * *